US005209082A

United States Patent [19]

Ha

[11] Patent Number: 5,209,082

[45] Date of Patent: May 11, 1993

[54] MULTI-PURPOSE REFRIGERATOR HAVING A DOOR WITHIN A DOOR

[75] Inventor: Dea Y. Ha, Seoul, Rep. of Korea

[73] Assignee: Samsung Electronics Co., Ltd., Suweon, Rep. of Korea

[21] Appl. No.: 826,877

[22] Filed: Jan. 28, 1992

[30] Foreign Application Priority Data

Jan. 29, 1991 [KR] Rep. of Korea ..... 91-1286

[51] Int. Cl.[5] ..... F25D 23/02

[52] U.S. Cl. ..... 62/265; 62/441; 312/236; 312/401

[58] Field of Search ..... 62/265, 408, 441, 448; 312/236, 402, 404

[56] References Cited

U.S. PATENT DOCUMENTS 4,586,347 5/1986 McCarty ..... 62/265
4,821,530 4/1989 Ledbetter ..... 62/448
4,898,294 2/1990 Jennings ..... 312/236

*Primary Examiner*—Ronald C. Capossela
*Attorney, Agent, or Firm*—Burns, Doane, Swecker & Mathis

[57] ABSTRACT

A multi-purpose refrigerator includes a main door and a fresh storage compartment mounted on a rear side of said main door and being accessible through an auxiliary door formed in said main door. The fresh storage compartment comprises a multi-section housing mounted to a pair of vertical walls disposed on the rear or inner side of the main door. Each housing section includes front and rear portions. The front portion fits between the walls. The rear portion is wider than the front portion to form shoulders therebetween. The shoulders carry hooks which fit removably into slots formed in rearwardly facing edges of the walls. The housing has openable apertures to communicate said refrigerator compartment with said fresh storage compartment.

11 Claims, 4 Drawing Sheets

MULTI-PURPOSE REFRIGERATOR HAVING A DOOR WITHIN A DOOR

BACKGROUND OF THE INVENTION

The invention is related to a multi-purpose refrigerator with a freezer compartment, a refrigerator compartment and a food storage structure provided near the refrigerator door having an additional door.

The conventional refrigerator used for a domestic purpose these days is divided into a refrigerator compartment and a freezing compartment. The freezer compartment stores food products to be frozen and the refrigerator compartment stores food products to be kept at a fresh condition and/or at a higher temperature. However, many kinds of food products, in particular, canned food products, need broader temperature ranges which make it necessary to sort the food products respectively by temperature requirement which requires the development of a refrigerator that can store a variety of food products at respective temperatures.

Particularly, it is known that an intermediate temperature compartment is installed within the refrigerator compartment having a separate exclusive door so that users can pick out food stuffs therefrom which are stored in the intermediate temperature compartment without opening the refrigerator compartment. The above typical structure is disclosed in U.S. Pat. No. 4,586,347. The prior art combination refrigerator provides an intermediate temperature compartment which comprises a horizontal dike and a vertical dike connected with a door panel which is formed by a synthetic resin and mounted in the refrigerator compartment door. At the top of the intermediate compartment the horizontal dike is placed; at both sides thereof the respective vertical dikes are placed and at the bottom thereof a demountable shelf is placed. Both the front and rear of the intermediate compartment are formed with a door panel. That is, the rear of the intermediate compartment is closed by a permanent hinged cover acting as an inner wall portion, thereby forming a fresh food compartment which can be accessed from the inside as well as from the outside. Further, a part of one of the vertical dikes is cut out, and the cut-out is aligned with a cool air duct to inflow air from the freezer compartment to the intermediate compartment. Thus, the intermediate temperature compartment is generally enclosed and thus prevents the loss of cool air. In other words, the upper portion of the fresh food compartment is confined by the horizontal dike which is formed at the upper portion thereof, and both sides are confined by the two vertical dikes.

However, the procedure for installing the dikes in the prior refrigerator increases the difficulty of manufacture, and the intermediate temperature compartment forms a structure which is colder than the refrigerator compartment and thus can not store a wide variety of the food products.

SUMMARY OF THE INVENTION

In view of the foregoing problems, an object of the present invention is to provide a multi-purpose food stuff storage structure which is detachable itself in order to enable most of the volume of the refrigerator compartment as possible to be utilized if desired.

Another object of the present invention is to provide a food stuff storage structure which can store a variety of food stuff and achieve convenient accessibility by use of a door-in-door.

According to the present invention, the refrigerator having a pair of side-by-side doors provides a food stuff storage compartment at approximately mid-height of the refrigerator compartment door. The temperature of the food stuff storage compartment is the same as or higher than that of the refrigerator compartment. The food stuff storage compartment is installed in a door panel which is formed conventionally by a synthetic resin and is located at the interior of the refrigerator compartment door. The door panel has a pair of walls at each vertical end of the door panel, and the wall extends toward the interior of the refrigerator compartment at a predetermined height. At the rear of each wall is mounted adhesively a hook receiving member which consists of an angle frame having a plurality of rectangular shape openings. Using the hook receiving member, an upper shelf is mounted detachably in the interior of the refrigerator compartment door. The upper shelf defines the ceiling of the food stuff storage compartment. In above joining manner, a cover member is mounted under the bottom of the upper shelf. Under the bottom of the cover member a lower shelf is mounted so as to create a gap for venting cool air from or to the refrigerator compartment. On the other hand, to attain an interchangeability, it is desirable that the configuration of the upper shelf be the same as that of the lower shelf. Alternatively, a dissimilar configuration may be employed for different usage.

The exterior type door-in-door is provided at the mid-height of the refrigerator compartment door. The bottom edge of the door-in-door is flush with the front top edge of the lower shelf, and the door-in-door is mounted pivotally by a pair of foldable supporting rods at both lower side walls. Since the door-in-door has a handle on the upper portion thereof, and has supporting rods, when the handle is pulled, the door-in-door swings open at a 90 degree angle and is held by the supporting rods, so the flat surface of the door-in-door foods can be selected.

Otherwise, the structure of the food stuffs storage compartment can be in a way in which the feature of the upper shelf is the same as the lower shelf.

The lower shelf comprises a front portion being tightly inserted in an internal portion configured by the walls, and a rear portion providing respective shoulders on both walls, and the shoulders having a plurality of hooks being inserted in the hook receiving member.

The cover member comprises the top plate so as to provide a cool air control device, a pair of side walls of which the external width equals the external width between the walls.

The wall members have a plurality of hook receiving members being positioned on each top portion of the wall member and extend respectively in a predetermined height across both side ends of the rear door panel.

The cool air control device further comprises a sliding member having a plurality of cool air vents which correspond to the respective openings made in the top plate.

When the upper shelf, the lower shelf and the cover member are installed, additional storage is created thereby so as to store the proper foods according to respective temperatures which are relatively higher or lower than the temperature of the refrigerator compartment depending on the opening state of the cool air control device. If desired, the shelves and the cover member can be removed, so that the usable space in the refrigerator compartment can be increased.

DESCRIPTION OF THE PREFERRED EMBODIMENT

Figure 1:
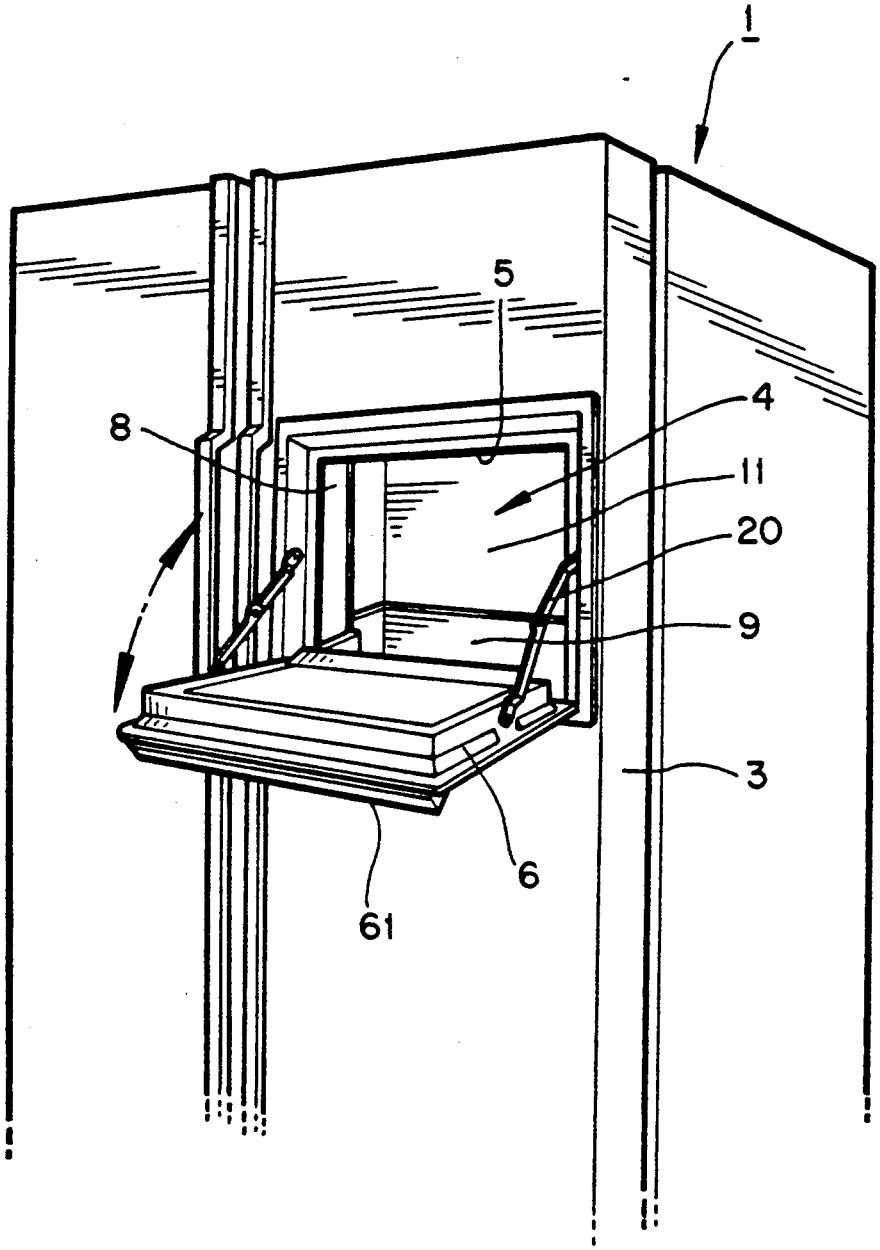
FIG. 1 is a perspective view illustrating a refrigerator having a multi-food stuff storage compartment which is installed in the upper portion of the refrigerator compartment door according to the present invention.

FIG. 1 is perspective view illustrating a refrigerator 1 having a door 6, fully opened, of a multi-food stuff storage compartment 4 which is installed at the upper portion of the refrigerator compartment door 3 according to the present invention. The door 6 is installed with hinges at both lower walls of an opening 5 provided in the door 3, and is connected with both walls of the opening 5 by a pair of foldable supports 20. A lower shelf 9 and a cover member 11 are installed on a wall 8 of a door panel which is described later, thereby forming the food stuff storage compartment 4. As shown in the drawing, when the door 6 is in an opened state, a beverage container or fruit which is kept in the lower shelf 9 can easily be picked up, and if a handle 61 which is formed on a front face of the door 6 is pushed upwardly, the door-in-door 6 is closed, thereby preventing cool air in the refrigerator compartment from being lost.

Figure 2:
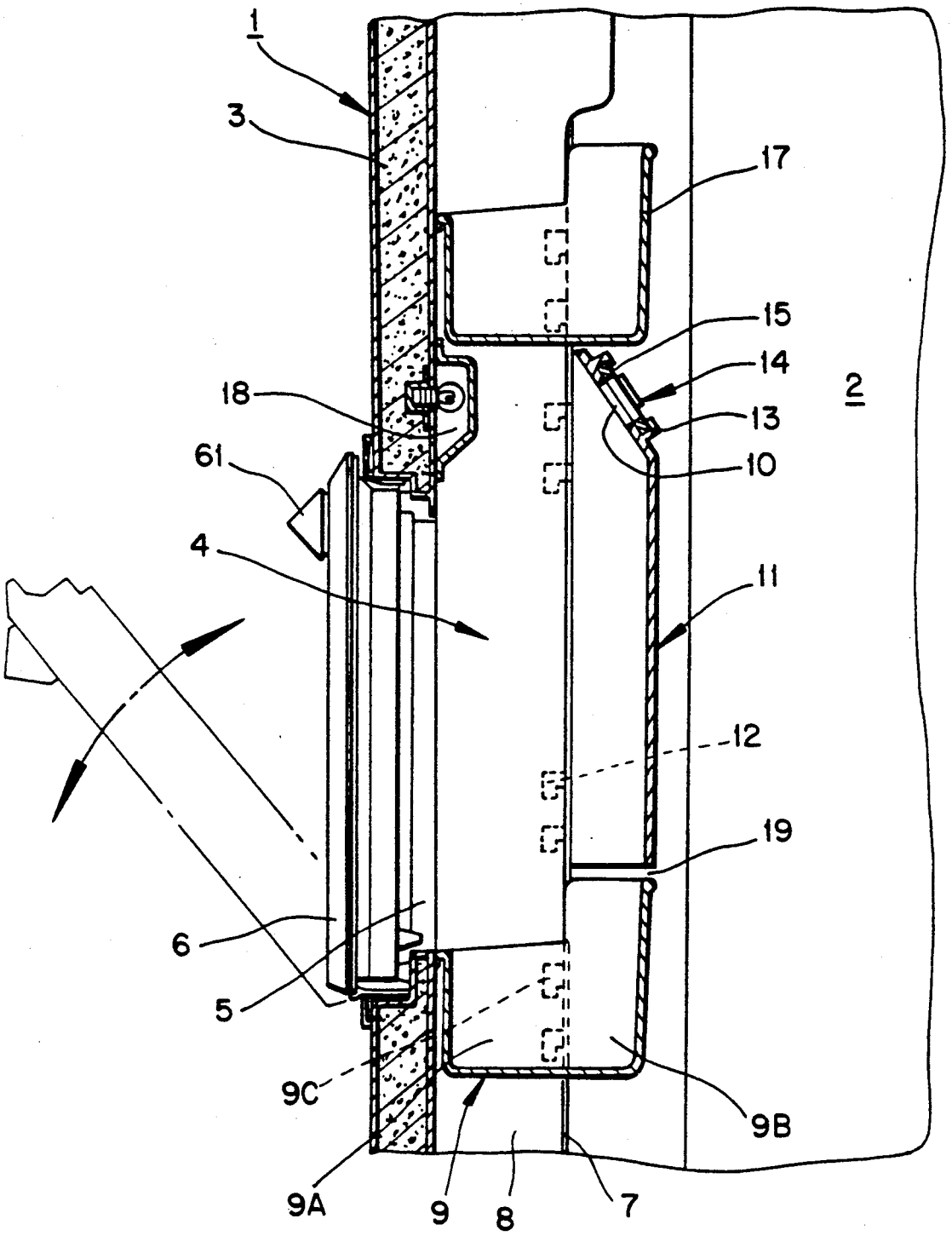
FIG. 2 is a sectional view illustrating a multi food stuff storage compartment according to the present invention.
Figure 3:
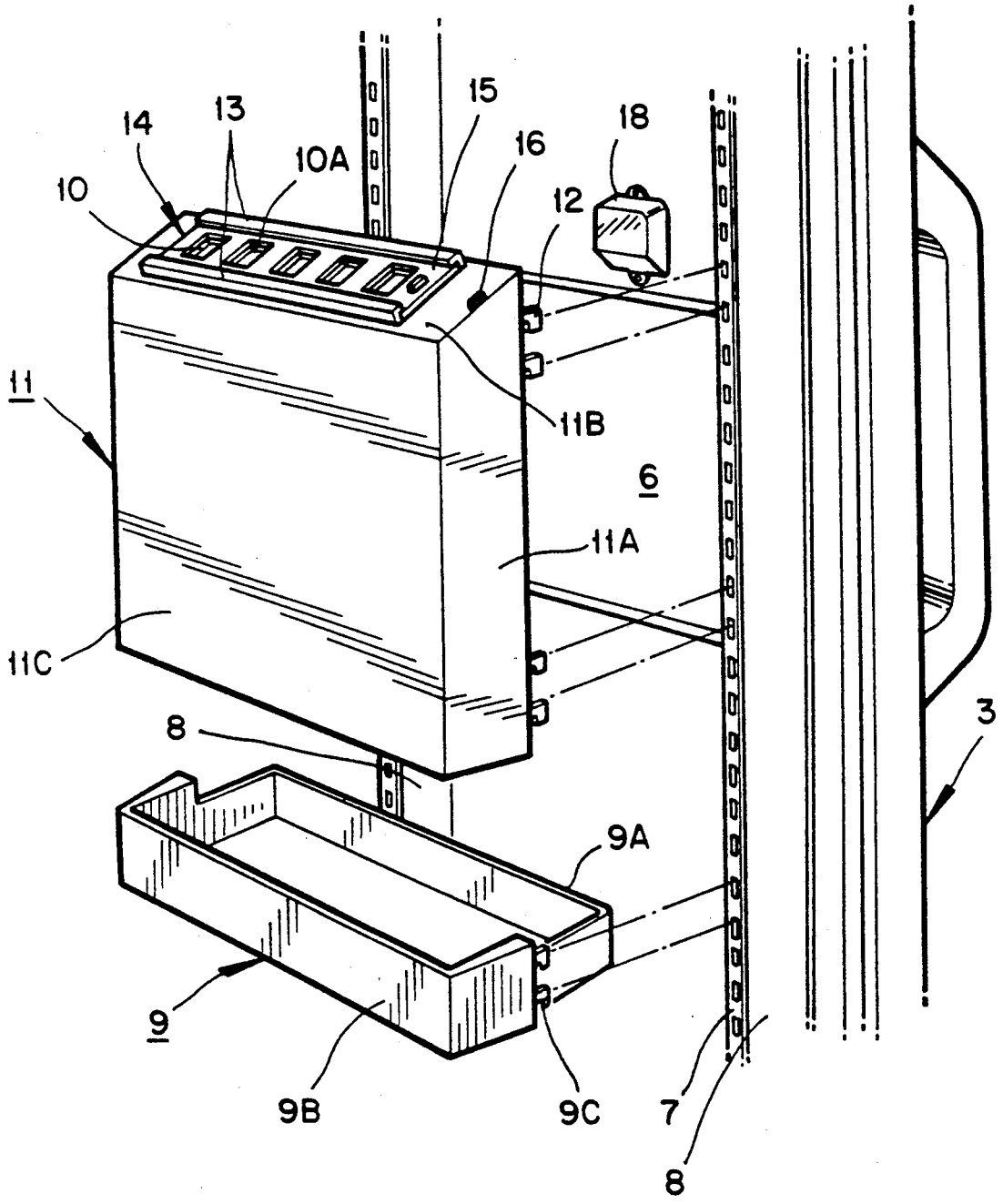
FIG. 3 is an exploded perspective view illustrating a multi food stuff storage compartment provided with a cover member and a lower shelf according to the present invention.

FIG. 2 is a sectional view illustrating the multi-food stuff storage compartment 4, and FIG. 3 is an exploded perspective view illustrating the back of the multi-food stuff storage compartment 4 provided with a back cover member 11 and a lower shelf 9. The combination refrigerator 1 is divided into a freezer compartment and a refrigerator compartment 2 having its own respective doors, as is conventional. Two walls 8, each with a predetermined width are formed on a door panel which is positioned at the back of the refrigerator compartment door 3. A hook receiving member 7 is detachablely fixed to the wall 8 by being inserted into a plurality of slots at the top side of the wall 8. The multi-food stuff storage compartment 4 comprises a removable, multi-section housing formed by an upper shelf 17, a lower shelf 9 and a cover member 11 which is arranged between the shelves 17 and 9. The configuration of the upper shelf 17 and the lower shelf 9 may be the same as shown in the drawing or may be different.

It is desirable for the lower shelf 9 to be installed at the lower portion of the door-in-door auxiliary or 6 at a flush level. A front portion 9A of the lower shelf 9 has a width so as to be inserted tightly between both walls 8. A rear portion 9B of the lower shelf 9 extends toward the internal space of the compartment from the front portion 9A in an integral manner and extends upwardly against the bottom of the cover member 11. A pair of shoulders are formed in both sides of the rear portion 9B. A maximum width dimension between the shoulders corresponds to the maximum exterior width dimension between the walls 8 when the front portion 9A is inserted into the walls 8. At the front of the shoulder, a plurality of hook members 9C are formed which correspond with the slots of the hook receiving members 7 in order to connect the hook members 9C with the slots of the hook receiving member 7.

The cover member 11 comprises a pair of side walls 11A of a width dimension which corresponds to the maximum exterior width dimension between the walls 8. The side wall 11A extends toward the interior of the compartment 2. At the front of side wall 11A, a plurality of a hook members 12 are formed which correspond with the slots of the hook receiving members 7 in order to connect the hook members 12 with the slots of the hook receiving members 7. The cover member 11 further comprises a top plate 11B with a slight slope. The top plate 11B has a plurality of openings 10 which are in approximate rectangular shape being arranged at intervals of a predetermined space. A rear wall 11C is molded integrally with the side walls 11A and the top plate 11B without forming a bottom plate in order to cooperate with the lower shelf 9.

Figure 4:
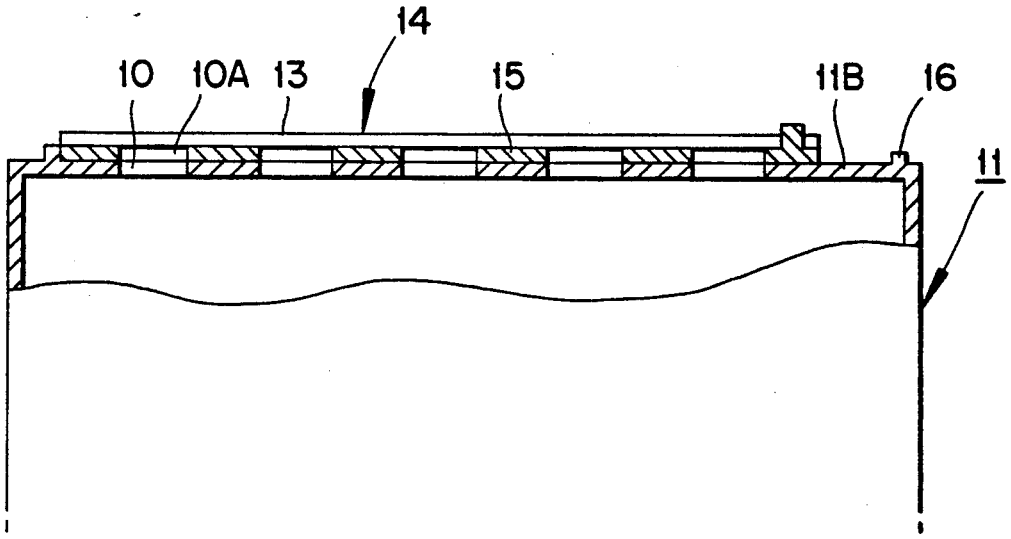
FIG. 4 is a sectional view illustrating a cover member having a cool air flow control assembly in a fully opened condition.
Figure 5:
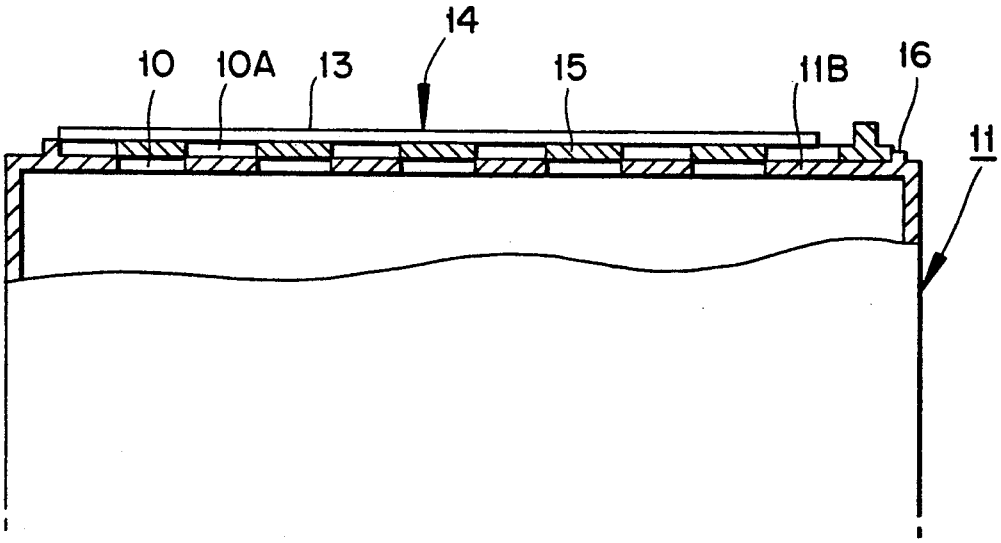
FIG. 5 is a sectional view illustrating a cover member having a cool air flow control assembly in a fully closed condition.

The cool air control device 14 comprises a sliding member 15 having a plurality of cool air vents 10A which correspond with the respective openings 10, and a guiding member 13 which is positioned in the top plate 11B for supporting the sliding member 15. As shown in FIGS. 4 and 5, when the cool air vents 10A of the sliding member 15 match the openings 10 of the top plate 11B, the temperature of the food stuff storage compartment 4 is the same as that of the refrigerator compartment 2. When the leading end of the sliding member 15 contacts with the stopper 16, the cool air vents are closed completely, and the temperature of the food stuff storage compartment 4 is relatively higher than that of the refrigerator compartment 2.

Back to FIG. 2, in the above structure, the upper shelf 17, the lower shelf 9 and the cover member 11 are located on the walls 8. A front top edge of the front portion 9A of the lower shelf 9 is flush with a lower boundary of the opening 5. The rear portion of the lower shelf 9 has relatively higher height. Adjoining the top edge of the rear portion 9B, the cover member 11 is positioned. Between the top edge of the rear portion 9B and the lower edge of the cover member 11, a gap 19 is created for venting air in the food stuff storage 4 from or into the refrigerator compartment 2. Or the gap may be eliminated so that the top edge of the rear portion 9B and the lower edge of the cover member 11 touch each other. Number 18 references a light which functions with the door-in-door 6.

The food stuff storage compartment 4 of the present invention stores canned food and bottled fruit, etc., on the lower shelf 9. The stored foods are picked up conveniently as the door 6 is opened. Further, the cover member 11 interrupts the flow of cool air in the refrigerator compartment 2 out through the opening 5, thereby preventing loss of cool air. Furthermore, when the upper shelf 17, the lower shelf 9 and the cover member 11 are removed, the interior volume of the refrigerator compartment 2 is increased, thereby utilizing the refrigerator compartment 2 for wider usage.

What is claimed is:

1. A multi-purpose refrigerator comprising a freezer compartment, a refrigerator compartment, a main door for opening and closing said refrigerator compartment, a rear side of said main door including a pair of spaced apart upstanding walls projecting rearwardly, a housing removably connected between said walls to define therein a fresh storage compartment, an aperture formed in said housing, manually removable temperature regulating means for selectively uncovering said aperture to communicate said refrigerator compartment and fresh storage compartment with one another, and an auxiliary door for affording access to said fresh storage compartment.

2. A multi-purpose refrigerator according to claim 1, wherein said housing is removably connected to said walls by a hook-and-slot coupling.

3. A multi-purpose refrigerator according to claim 1, wherein said housing comprises a plurality of sections disposed one above the other.

4. A multi-purpose refrigerator according to claim 3, wherein said sections include upper and lower sections and an intermediate cover section, said lower section forming a shelf.

5. A multi-purpose refrigerator according to claim 1, wherein said housing includes a front portion fitting between said walls, and a rear portion extending rearwardly past said walls, said rear portion being wider than said front portion to form shoulders therebetween, said shoulders being removably connected to rearwardly facing edges of said walls.

6. A multi-purpose refrigerator according to claim 5, wherein said shoulders are removably connected to said rearwardly facing edges by a hook-and-slot coupling.

7. A multi-purpose refrigerator according to claim 6, wherein said hook-and-slot coupling comprises vertically spaced hooks carried by a forwardly facing surface of said shoulder, and vertically spaced slots formed in said rearwardly facing edges of said walls.

8. A multi-purpose refrigerator according to claim 5, wherein said housing comprises a plurality of sections disposed one above the other, each of said sections including said front and rear portions.

9. A multi-purpose refrigerator according to claim 1, wherein said manually movable temperature regulating means comprises a slide having a cool air vent which mates with said aperture.

10. A multi-purpose refrigerator according to claim 1, herein said auxiliary door is located on a front side of said main door.

11. A multi-purpose refrigerator comprising a freezer compartment, a refrigerator compartment, a main door for opening and closing said refrigerator compartment, a rear side of said main door including a pair of spaced apart upstanding walls projecting rearwardly, a housing removably connected between said walls to define therein a fresh storage compartment, an auxiliary door formed in said main door for affording access to said fresh storage compartment, said housing comprising a plurality of sections disposed one above the other, each section including a front portion fitting between said walls and a rear portion extending rearwardly past said walls, said rear portion being wider than said front portion to form shoulders therebetween, hook-and-slot couplings formed between forwardly facing surfaces of said shoulder and rearwardly facing edges of said walls for removably securing said sections to said walls, said housing including an aperture and manually movable temperature regulating means for selectively uncovering said aperture for communicating said fresh storage compartment with said refrigerator compartment.

* * * * *